US005566784A

United States Patent [19]

Rennetaud

[11] Patent Number: 5,566,784

[45] Date of Patent: Oct. 22, 1996

[54] SELF-PROPELLED ELEVATOR SYSTEM

[75] Inventor: Jean-Marie Rennetaud, Farmington, Conn.

[73] Assignee: Otis Elevator Company, Farmington, Conn.

[21] Appl. No.: 272,166

[22] Filed: Jul. 8, 1994

[51] Int. Cl.[6] ..... B66B 9/00

[52] U.S. Cl. ..... 187/249; 187/257

[58] Field of Search ..... 187/249, 201, 187/239, 257, 258, 270, 410; 182/12, 148, 141, 36

[56] References Cited

U.S. PATENT DOCUMENTS

| | | | |
|---|---|---|---|
| 2,052,690 | 9/1936 | Austin | 187/249 |
| 2,514,498 | 7/1950 | Kesler | 187/270 |
| 5,117,946 | 6/1992 | Traktovenko et al. | 187/95 |
| 5,158,156 | 10/1992 | Okuma et al. | 187/17 |
| 5,183,980 | 2/1993 | Okuma et al. | 187/112 |
| 5,197,570 | 3/1993 | Matsui | 187/16 |
| 5,203,432 | 4/1993 | Grinaski | 187/18 |
| 5,234,079 | 8/1993 | Nomura | 187/80 |
| 5,235,144 | 8/1993 | Matsui et al. | 187/112 |
| 5,288,956 | 2/1994 | Kadokura et al. | 187/112 |
| 5,464,072 | 11/1995 | Muller | 187/249 |

FOREIGN PATENT DOCUMENTS

| | | |
|---|---|---|
| 2079096 | 8/1992 | Canada . |
| 2085309 | 12/1992 | Canada . |
| 2088470 | 1/1993 | Canada . |
| 2258215 | 2/1993 | United Kingdom . |
| 9205057 | 2/1992 | WIPO . |

*Primary Examiner*—Kenneth Noland

[57] ABSTRACT

An elevator system employing a self-propelled elevator car is disclosed. One embodiment of the elevator system includes an elevator car (10) arranged for travel along a hoistway (12), a plurality of electric motors (16) disposed on the elevator car (10), a plurality of traction rollers (22) fixed to torque output shafts (20) of the electric motors (16) respectively, a pair of guide rails (14), which are in engagement with the traction rollers (22), extending along the hoistway (12). According to the invention, firstly, because the elevator car (10) is self-propelled by the electric motors (16) disposed on the elevator car (10), neither rope nor counterweight is necessary unlike some existing elevators. Secondly, the torque provided by each of the electric motors (16) is directly transmitted to the guide rails (14) via each of the traction rollers (22). Thus, on the one hand, there is a less complicated torque transmission mechanism with the elevator system. On the other hand, the noise emitted from the torque transmission mechanism may be reduced compared with that from some conventional torque transmission mechanisms, for example, a gear box or a chain. Thirdly, various types of conventional driving means could be employed in the present invention, e.g., an ac motor or a dc motor. Therefore, traditional speed regulating methods and devices may be applied.

3 Claims, 4 Drawing Sheets

SELF-PROPELLED ELEVATOR SYSTEM

TECHNICAL FIELD

This invention relates generally to elevators and particularly to a self-propelled elevator system without a rope and a counterweight.

BACKGROUND ART

Conventional elevators illustratively have a car arranged for travel along a vertical hoistway, a rope to move the car upward or downward in the hoistway, the rope firmly connected to the car at one extremity of the rope, a counterweight to compensate the weight and the payload of the car, the counterweight firmly connected to the rope at the other extremity thereof, and a traction machine such as an electric motor for driving the rope.

In this typical configuration of existing elevators, however, the present inventor believes that several disadvantages may lie, for example:

Both large and heavy equipment such as a traction machine, a drum, and a sheave are typically installed at the top or the bottom of the hoistway. This requires extra space for installation of those equipment in the building.

Wear of the rope and the sheave should be frequently monitored so as to satisfy the elevator satiety standard.

Guiding facilities for the car and the counterweight must be provided in the hoistway; thus, the whole structure of the hoistway tends to be complicated. This also results in high construction costs.

In order to overcome these perceived shortcomings of the existing elevators, several proposals have been made in the art.

One of these proposals is a self-propelled elevator employing a linear motor as a traction mechanism. In this type of an elevator system, the primary of the linear motor is installed either on the car or on the inner surface of the hoistway in the building and the secondary is attached as faced the primary with a certain gap. See, for example, U.S. Pat. No. 5,203,432 to Grinaski entitled "Flat Linear Motor Driven Elevator." However, the present inventor believes that this configuration still is less than entirely satisfactory:

The construction cost of the system may be sometimes expensive and not commercially viable without superconductivity or equivalent.

The linear motor is often undesirable, compared with conventional ac/dc motors, in terms of power consumption, because of low efficiency and low power factor. See also U.S. Pat. No. 5,158,156 to Okuma et.al. entitled "Linear Motor Elevator with Support Wings for Mounting Secondary Side Magnets on an Elevator Car."

On the other hand, Canadian laid-open patent publication No. 2,079,096, entitled "Lift, in Particular Inclined Lift" describes the following structure.

The two lift rails follow the path of a winding staircase and are fixed to the wall at a constant vertical distance apart. On the lift cage frame is an upper pivot plate with a driven roller and opposing spring-loaded roller between which the top rail is gripped. Smaller guide rollers align the pivot plate on the rail. A motor and gearbox drive onto the shaft of the driven roller. A chain transmits the driving force to an identical lower pivot plate and assembly gripping the bottom rail. Thus, the lift of this disclosure can be self-propelled along the two rails. However, this technique may still have the following drawbacks:

The driving force transmission mechanism may be complicated because of the gearbox and the chain. Frequent maintenance is sometimes necessary to keep reliable operation.

Because the driving force transmission mechanism is disposed on the car, the noise emitted from the mechanism may be high enough to make passengers feel less comfortable sometimes.

DISCLOSURE OF THE INVENTION

According to the present invention, an elevator system includes an elevator car arranged for travel along a hoistway, a plurality of driving means for providing driving torques, the driving means being disposed on the elevator car, a plurality of torque transferring means for transferring the driving torques provided by the driving means, the torque transferring means being connected to the plurality of driving means, respectively, and a plurality of elongated structures which is in engagement with the torque transferring means, extending along the hoistway.

A feature of the present invention is a number of driving means disposed on the elevator car.

Another feature of the present invention is a number of torque transferring means connected to a respective number driving means.

A further feature of the present invention is a plurality of elongated structures which is in engagement with the torque transferring means, extending along the hoistway.

A principal advantage of the present invention is the self-propulsion of the elevator car. Firstly, because the elevator car is self-propelled by the driving means disposed on the car, neither rope nor counterweight is necessary unlike some existing elevators. Secondly, the torque provided by each of the driving means is directly transmitted to the elongated structures via each of the torque transferring means. Thus, on the one hand, there is a less complicated torque transmission mechanism with the elevator system. On the other hand, the noise emitted from the torque transmission mechanism may be reduced compared with that from some conventional torque transmission mechanism, for example, a gear box or a chain. Thirdly, various types of conventional driving means could be employed in the present invention, e.g., an ac motor or a dc motor. Therefore, traditional speed regulating methods and devices may be applied.

Other features and advantages of the present invention will become more apparent in light of the following detailed description of the best mode to carry out the invention and in the accompanying drawing.

DESCRIPTION OF PREFERRED EMBODIMENTS AND BEST MODE FOR CARRYING OUT THE INVENTION

Figure 1:
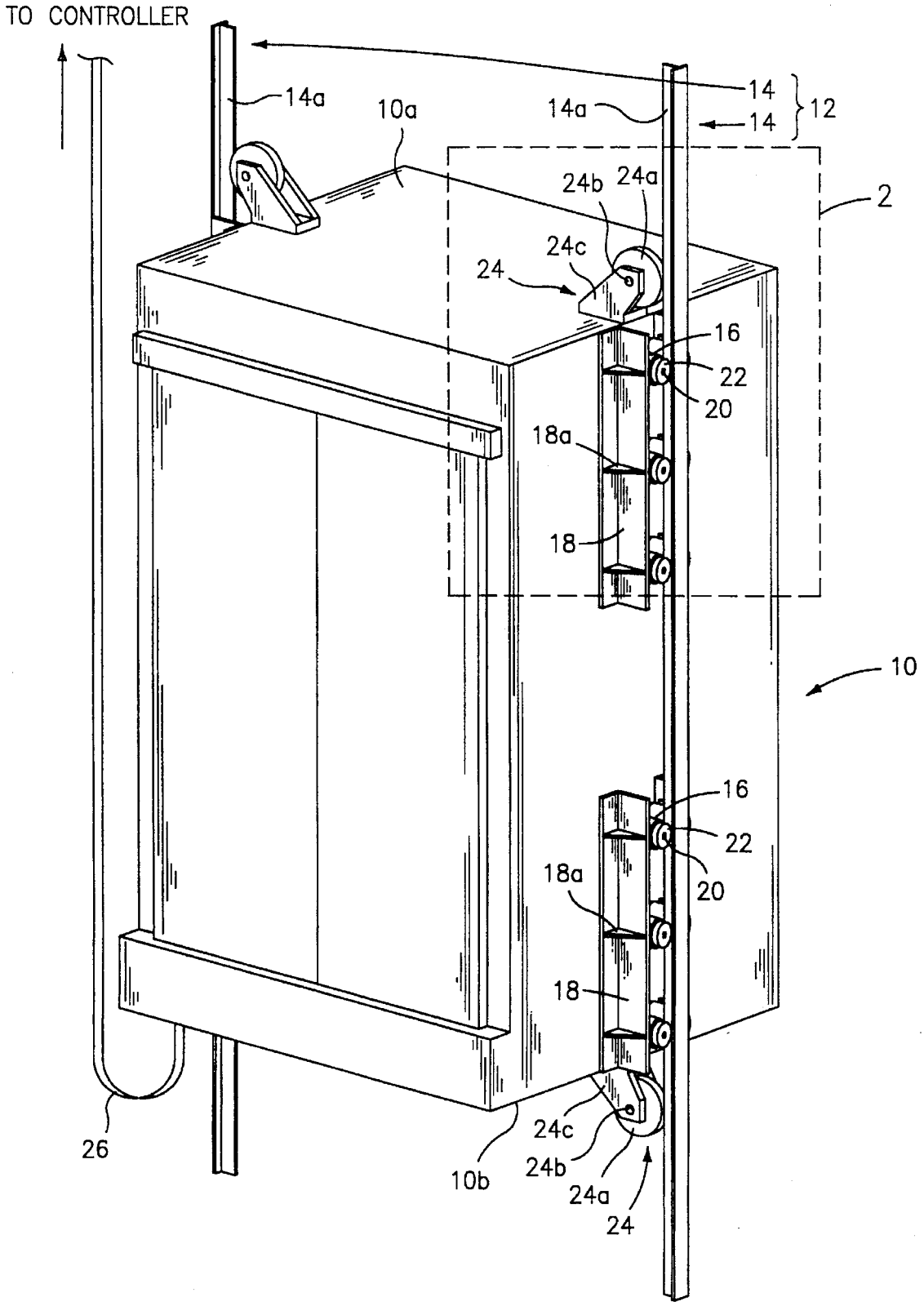
FIG. 1 is a perspective view of the elevator system of the present invention.

FIG. 1 typically illustrates the elevator system of this invention.

An elevator car 10 is installed in a hoistway 12. The hoistway 12 is arranged for travel of the elevator car 10 through almost entire length thereof, and is defined by a plurality of elongated structures, such as a pair of guide rails 14, which function as traction rails for receiving traction force of the elevator car 10. Ordinarily, the hoistway 12 is built as a shaft formed by building walls (not shown). Typically, buffers (not shown) are present at the bottom (not shown) of the hoistway 12.

Figure 2:
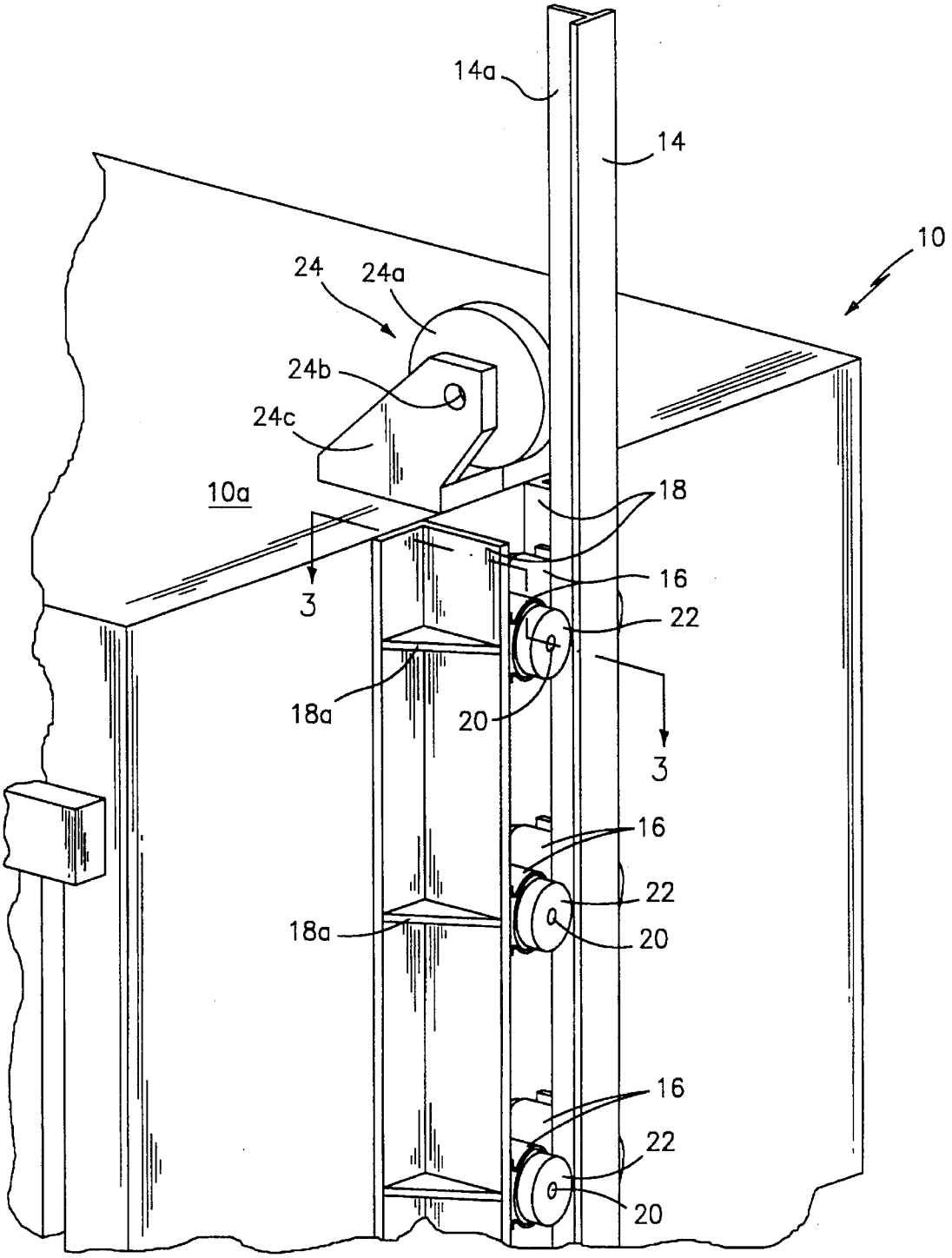
FIG. 2 is an enlarged view of the portion of FIG. 1 surrounded by a dashed line shown in FIG. 1.

The guide rails 14 are, as shown in FIG. 1 or FIG. 2, installed on each side of the elevator car 10 respectively in this embodiment. Each of the guide rails 14 is, for example, a T-shaped (in cross-section) beam made of a durable hard material such as metal (e.g., steel).

On the elevator car 10, there is disposed a plurality of driving means such as electric motors 16. As shown in FIG. 1 or FIG. 2, the electric motors 16 are arranged into six (6) pairs of opposing motors which are located on each side of the projecting portion 14*a* of the T-shaped guide rail 14. Consequently, twenty four (24) electric motors 16 are installed on the elevator car 10 in this embodiment. As an electric motor 16, any kind of conventional motor such as an ac motor, a dc motor, is employed. One example of a motor which may be preferably used in this invention is a squirrel-cage type 3-phase ac induction motor, model No. 1LA6, 22 kW at 975 rpm, 6 poles, 50 Hz, manufactured by Siemens.

In this embodiment, for example, twenty four (24) motors 16 are equipped with the elevator car 10. However, it is apparent that one who employs the elevator system of the present invention may determine an optimum number of motors for fulfillment of required performance, cost-effectiveness, etc. In other words, the number of onboard motors may not be limited to the particular figure such as twenty four (24).

Figure 3:
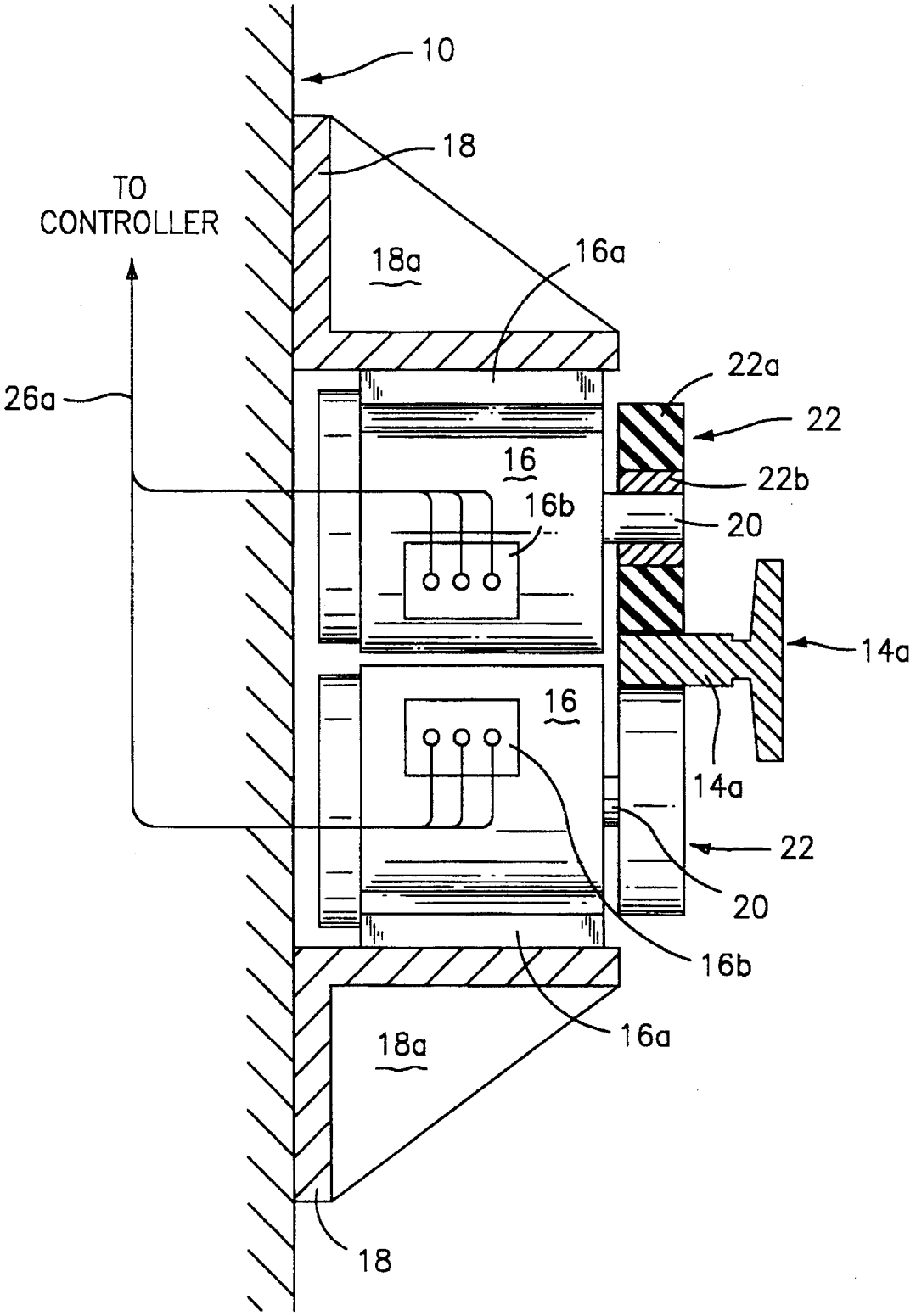
FIG. 3 is a top schematic view partially in cross-section, showing two driving means connected to two transferring means in engagement with a guide rail, all according to the present invention.

As shown in FIG. 3, each of the electric motors 16 includes a base 16*a* in this embodiment. The base 16*a* may be, for example, a rigid metal plate, which is integrally fixed to the electric motor 16.

For installation of those electric motors 16, a plurality of base frames 18 is attached on the elevator car 10 by a known fixing method, for example, by welding. Each of the base frames 18 is an L-shaped channel with ribs 18*a* for enforcement. The electric motors 16 are attached to the base frames 18 at the bases 16*a* by known fastening means, for example, by bolts and nuts (not shown). Therefore, the electric motors 16 are installed on the elevator car 10 via the base frames 18, as shown in FIG. 3.

Each of the electric motors 16 has a torque output shaft 20 as shown in FIG. 1 through FIG. 3. The torque output shaft 20 provides a rotational output of the electric motor 16.

Each of a plurality of torque transferring means (e.g., traction rollers 22) is fixed at one end of the respective torque output shaft 20. Each of the traction rollers 22 includes a peripheral portion 22*a* and a hub 22*b*. The peripheral portion 22*a* is formed of an elastic durable material, for example, a synthetic resin or rubber. The material is selected so as to produce a required friction against the guide rail 14. The hub 22*b* is typically made of metal. The hub 22*b* is fixed to one end of the torque output shaft 20 of the electric motor 16 in any conventional method, for example, by a bolt (not shown). The peripheral portion 22*a* and the hub 22*b* are integrally coupled by any of known methods, for example, by adhesive, in order to form the traction roller 22.

The traction rollers 22 are urged toward the guide rails 14 such that sufficient friction between the traction rollers 22 and the guide rails 14 is produced so as to propel the elevator car 10 along the guide rails 14 when the electric motors 16 are operative normally.

On each side of the top surface 10*a* and the bottom surface 10*b* of the elevator car 10, there is disposed a pair of guiding assemblies 24 respectively which faces each of the guide rails 14. Each of the guiding assemblies 24 comprises a guiding roller 24*a*, a pin 24*b*, and a bracket 24*c*. The guiding roller 24*a* is rotatably supported in the bracket 24*c* by the pin 24*b*. The brackets 24*c* are fixed to the elevator car 10 in any conventional fashion such as by bolts (not shown). The guiding rollers 24*a* are urged toward the guide rails 14 at the end of the projecting portions 14*a* thereof, so as to stabilize the elevator car 10 against movement in a lateral direction.

Figure 4:
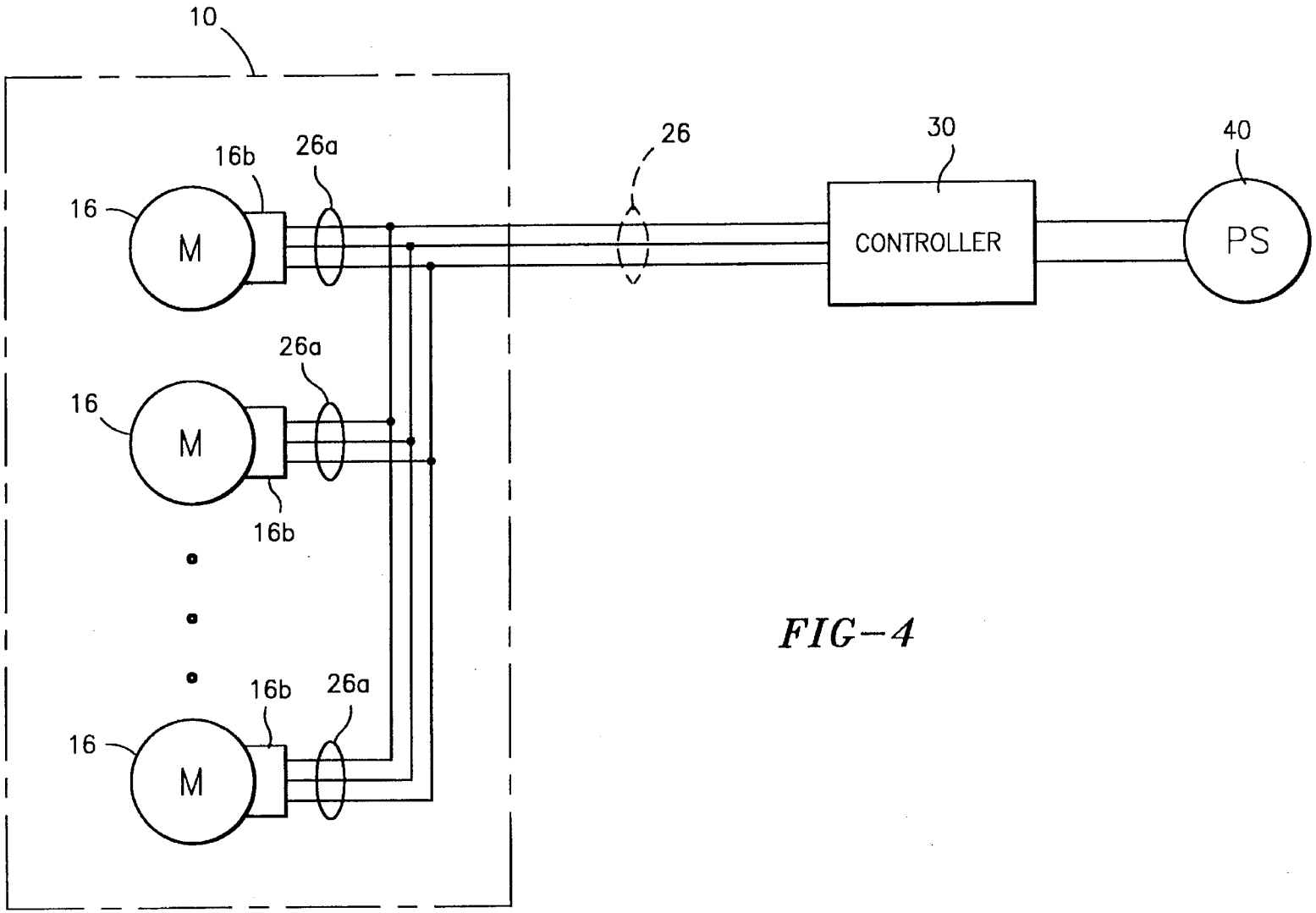
FIG. 4 is a schematic diagram, showing a typical power supply configuration for the present invention, including a plurality of driving means disposed on the elevator car, a controller, and a power supply (e.g., a DC electrical energy source).

FIG. 4 shows a schematic diagram of a typical power supply configuration of the present invention. The electric motors 16 disposed on the elevator car 10 are driven by a controller 30 of various conventional types, which is suitable for drive of a specific motor, connected to any suitable source of electrical energy 40. Typically, the controller 30 includes a drive unit having conventional power conditioning circuitry (e.g., rectifiers, etc.), and also includes operational and motion control systems which are also conventional, therefore, will not be further discussed. The controller 30 is placed in a certain place, for example, on the ground level of the building in which the elevator system of the present invention is installed, so that the devices of the controller 30 may be easily maintained.

Driving current for the electric motors 16 is provided through a set of power supply cables 26, onboard power supply wirings 26*a*, and terminal boxes 16*b* disposed on the respective electric motors 16. (See also FIG. 1 and FIG. 3.) With employing a known non-contact power transmission technology such as a microwave transmission or an electromagnetic induction, etc., the power supply cables 26 may be omitted.

In the embodiment with the power supply cables 26, the characteristics of the electric motor 16 are estimated according to the following formulas:

$$\text{Peak torque} = W*(x+x_1)*d/(2n)(\text{kgm})$$

$$\text{Rated torque} = W*x*d/(2n)\ (\text{kgm})$$

$$\text{Rotation speed} = a/(3.14*d)(\text{rpm})$$

$$\text{Rated power} = W*a*x/(60*f)(\text{Watt})$$

where a: Linear speed of an elevator car (m/min)

f:Hoistway efficiency

W:Total mass of an elevator car (kg)

x:Acceleration rate of gravity ($m/s^2$)

$x_1$:Acceleration rate of an elevator car ($m/s^2$)

d:Diameter of a traction roller (m)

n:Number of motors

As one example of the basic configurations of the elevator system of this invention, an elevator car with total mass of 4300 kg, which travels in 15 m/s with a duty load of 1800 kg, would be equipped with 10 motors of 99 kW at 3600 rpm, 4 poles, 120 Hz, Frame size 346.

OPERATION

The controller 30 provides predetermined power to the electric motors 16 via the power supply cables 26, the onboard power supply wirings 26*a*, and the terminal boxes 16*b* disposed on the respective electric motors 16, so as to cause the elevator car 10 of a certain load to travel at a certain speed and/or acceleration rate.

The traction rollers 22 are rotated by the electric motors 16 via the respective torque output shafts 20. The traction rollers 22 are urged toward the guide rails 14 with certain lateral forces determined based on coefficients of friction between the traction rollers 22 and the guide rails 14. The lateral force is illustratively calculated with employing the following formula:

$$\text{Lateral force} = W*(x+x_1)/(\mu*n)\ (\text{N})$$

where W:Total mass of an elevator car (kg)

x:Acceleration rate of gravity ($m/s^2$)

$x_1$:Acceleration rate of an elevator car ($m/s^2$)

μ:Coefficient of friction between the traction roller 22 and the guide rail 14 n:Number of motors

Therefore, the elevator car 10, on which the electric motors 16 are disposed, travels along the guide rails 14 extending throughout the hoistway 12 with the rotation of the traction rollers 22 by the electric motors 16.

The guide rollers 24*a* of the guiding assemblies 24 are urged toward the guide rails 14 disposed on both sides of the elevator car 10 respectively. Thus, the elevator car 10 is prevented from movement or vibration in a lateral direction.

It should be understood that the invention is not limited to the particular embodiments shown and described herein, but that various changes and modifications may be made without departing from the spirit and scope of the invention as defined by the following claims.

Having thus described the invention, what is claimed is:

1. An elevator system having a car for guided travel within a hoistway, the hoistway including a rail extending longitudinally through the hoistway and engaged with the car to guide the travel of the car, the elevator system including:

a pair of opposing, independent drive means disposed on the car, each drive means including a rotatable output shaft;

a pair of traction rollers, each traction roller disposed on one of the pair of output shafts, the traction rollers engaged with opposite sides of the rail and biased towards the rail to provide sufficient traction between the rail and rollers to propel the ear along the rail.

2. The elevator system according to claim 1, wherein the hoistway further includes a second rail extending longitudinally through the hoistway and engaged with the opposite side of the car from the first rail, and wherein the elevator system further includes a second pair of opposing, independent drive means disposed on the opposite side of the car, each having a rotatable output shaft, and a second pair of traction rollers disposed on the second pair of output shafts and engaged with the opposite sides of the second rail, each biased towards the rail.

3. The elevator system according to claim 2, further including a pair of guiding assemblies, each guiding assembly having a guiding roller engaged with one of the rails so as to stabilize the elevator car against lateral movement.

* * * * *